US010599059B2

(12) United States Patent
Suzuki et al.

(10) Patent No.: US 10,599,059 B2
(45) Date of Patent: Mar. 24, 2020

(54) TONER, IMAGE FORMING APPARATUS, IMAGE FORMING METHOD, AND TONER STORAGE UNIT

(71) Applicants: Namie Suzuki, Shizuoka (JP); Kazumi Suzuki, Shizuoka (JP); Hisashi Nakajima, Shizuoka (JP); Yoshitaka Yamauchi, Shizuoka (JP); Kohtaroh Ogino, Shizuoka (JP); Akihiro Kaneko, Shizuoka (JP)

(72) Inventors: Namie Suzuki, Shizuoka (JP); Kazumi Suzuki, Shizuoka (JP); Hisashi Nakajima, Shizuoka (JP); Yoshitaka Yamauchi, Shizuoka (JP); Kohtaroh Ogino, Shizuoka (JP); Akihiro Kaneko, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/293,691

(22) Filed: Mar. 6, 2019

(65) Prior Publication Data

US 2019/0278191 A1 Sep. 12, 2019

(30) Foreign Application Priority Data

Mar. 12, 2018 (JP) ..... 2018-044609

(51) Int. Cl.
*G03G 9/08* (2006.01)
*G03G 9/087* (2006.01)
(Continued)

(52) U.S. Cl.
CPC ..... *G03G 9/0821* (2013.01); *G03G 9/08755* (2013.01); *G03G 9/08782* (2013.01);
(Continued)

(58) Field of Classification Search
CPC ..... G03G 9/09307; G03G 9/09708
(Continued)

(56) References Cited

U.S. PATENT DOCUMENTS 6,248,494 B1 * 6/2001 Yamazaki ..... G03G 9/09 430/108.6
2007/0190444 A1 8/2007 Kotsugai et al.
(Continued)

FOREIGN PATENT DOCUMENTS

JP 6-313980 11/1994
JP 7-028276 1/1995
(Continued)

OTHER PUBLICATIONS

U.S. Appl. No. 16/210,003, filed Dec. 5, 2018 Toyoshi Sawada, et al.
(Continued)

*Primary Examiner* — Mark A Chapman
(74) *Attorney, Agent, or Firm* — Oblon, McClelland, Maier & Neustadt, L.L.P.

(57) ABSTRACT

A toner is provided. The toner comprises mother particles and an external additive covering the mother particles. The mother particles comprise a binder resin, and the external additive comprises inorganic particles. The inorganic particles comprise small-size inorganic particles having an equivalent circle diameter of from 30 to 70 nm and large-size inorganic particles having an equivalent circle diameter of from 150 to 200 nm and a circularity of 0.85 or more. The large-size inorganic particles are 20 to 70 in number per 100 $\mu m^2$ image area of the toner observed with a field-emission scanning electron microscope.

7 Claims, 3 Drawing Sheets

(51) Int. Cl.

| | |
|---|---|
| ***G03G 15/08*** | (2006.01) |
| ***G03G 15/09*** | (2006.01) |
| ***G03G 9/097*** | (2006.01) |
| ***G03G 9/093*** | (2006.01) |

(52) U.S. Cl.
CPC ..... *G03G 9/08795* (2013.01); *G03G 9/08797* (2013.01); *G03G 9/09307* (2013.01); *G03G 9/09708* (2013.01); *G03G 15/0806* (2013.01); *G03G 15/09* (2013.01)

(58) Field of Classification Search
USPC ..... 430/108.1, 110.2
See application file for complete search history.

(56) References Cited

U.S. PATENT DOCUMENTS

| | | | | |
|---|---|---|---|---|
| 2013/0130171 | A1* | 5/2013 | Watanabe | G03G 9/0825 430/110.2 |
| 2016/0327884 | A1 | 11/2016 | Nakajima et al. | |
| 2018/0067409 | A1 | 3/2018 | Yamauchi et al. | |
| 2018/0113391 | A1 | 4/2018 | Yamauchi et al. | |
| 2018/0267418 | A1 | 9/2018 | Ogino et al. | |
| 2018/0329326 | A1 | 11/2018 | Matsushita et al. | |

FOREIGN PATENT DOCUMENTS

| | | |
|---|---|---|
| JP | 2001-066820 | 3/2001 |
| JP | 2002-318467 | 10/2002 |
| JP | 2005-060214 | 3/2005 |
| JP | 2007-241243 | 9/2007 |
| JP | 2014-077930 | 5/2014 |
| JP | 2016-139062 | 8/2016 |
| JP | 2017-142392 | 8/2017 |

OTHER PUBLICATIONS

U.S. Appl. No. 16/133,825, filed Sep. 18, 2018 Kazumi Suzuki, et al.

* cited by examiner

TONER, IMAGE FORMING APPARATUS, IMAGE FORMING METHOD, AND TONER STORAGE UNIT

CROSS-REFERENCE TO RELATED APPLICATIONS

This patent application is based on and claims priority pursuant to 35 U.S.C. § 119(a) to Japanese Patent Application No. 2018-044609, filed on Mar. 12, 2018, in the Japan Patent Office, the entire disclosure of which is hereby incorporated by reference herein.

BACKGROUND

Technical Field

The present disclosure relates to a toner, an image forming apparatus, an image forming method, and a toner storage unit.

Description of the Related Art

A technique of externally adding small-size inorganic particles as a fluidizer to toner is generally known for adjusting fluidity and chargeability of the toner to achieve good development characteristics.

On the other hand, some small-size inorganic particles undesirably separate from the surface of toner and migrate to carriers and photoconductors. Such a problem is remarkably caused by color toner for color printing, compared with monochrome toner for black-and-white printing, since color toner contains a large amount of fluidizer for greatly improving fluidity and enhancing developability and image quality. As the fluidizer migrates to the photoconductor, the fluidizer adheres to or accumulates on a photoconductor cleaner or a transfer unit, causing deterioration of image quality. While imparting high fluidity to the toner, the fluidizer may separate from the surface of the toner and migrate to carriers or photoconductors or contaminate the inside of a developing device.

In addition, since the small-size inorganic particles tend to be embedded in the toner surface due to mechanical stress received in a developing device, the toner surface and the carrier surface are brought into direct contact with each other and the physical adhesion force therebetween increases. As a result, developability and transferability of the developer deteriorate over time and the developer is unable to exhibit sufficient durability.

SUMMARY

In accordance with some embodiments of the present invention, a toner is provided. The toner comprises mother particles and an external additive covering the mother particles. The mother particles comprise a binder resin, and the external additive comprises inorganic particles. The inorganic particles comprise small-size inorganic particles having an equivalent circle diameter of from 30 to 70 nm and large-size inorganic particles having an equivalent circle diameter of from 150 to 200 nm and a circularity of 0.85 or more. The large-size inorganic particles are 20 to 70 in number per 100 $\mu m^2$ image area of the toner observed with a field-emission scanning electron microscope.

In accordance with some embodiments of the present invention, an image forming apparatus is provided. The image forming apparatus comprises: an electrostatic latent image bearer; an electrostatic latent image forming device configured to form an electrostatic latent image on the electrostatic latent image bearer; a developing device containing the above-described toner, configured to develop the electrostatic latent image with the toner to form a toner image; a transfer device configured to transfer the toner image formed on the electrostatic latent image bearer onto a surface of a recording medium; and a fixing device configured to fix the toner image on the surface of the recording medium.

In accordance with some embodiments of the present invention, an image forming method is provided. The image forming method includes the processes of: forming an electrostatic latent image on an electrostatic latent image bearer; developing the electrostatic latent image with the above-described toner to form a toner image; transferring the toner image formed on the electrostatic latent image bearer onto a surface of a recording medium; and fixing the toner image on the surface of the recording medium.

In accordance with some embodiments of the present invention, a toner storage unit is provided. The toner storage unit includes a container and the above-described stored in the container.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
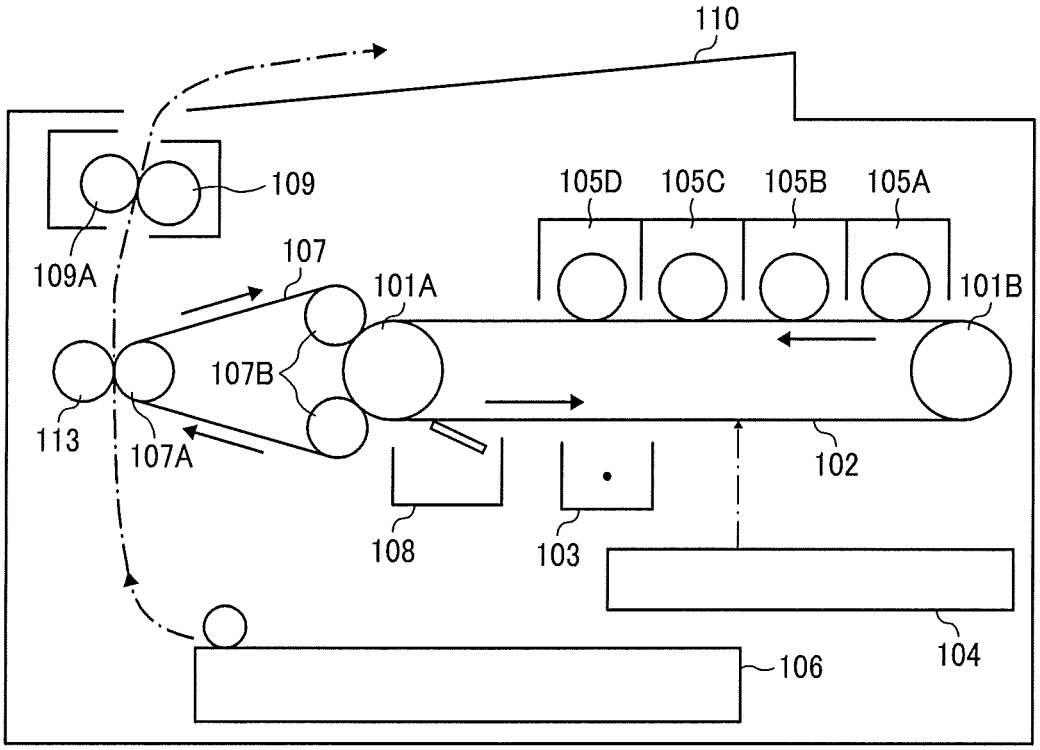
FIG. 1 is a schematic view of a full-color image forming apparatus according to an embodiment of the present invention.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Embodiments of the present invention are described in detail below with reference to accompanying drawings. In describing embodiments illustrated in the drawings, specific terminology is employed for the sake of clarity. However, the disclosure of this patent specification is not intended to be limited to the specific terminology so selected, and it is to be understood that each specific element includes all technical equivalents that have a similar function, operate in a similar manner, and achieve a similar result.

For the sake of simplicity, the same reference number will be given to identical constituent elements such as parts and materials having the same functions and redundant descriptions thereof omitted unless otherwise stated.

In accordance with some embodiments of the present invention, a toner holding inorganic particles on a surface thereof having excellent durability and developability is provided. The toner maintains excellent fluidity for an extended period of time while suppressing separation of the inorganic particles from the toner surface and adhesion of the separated inorganic particles to a photoconductor or the inside of a developing device.

A toner, an image forming apparatus, an image forming method, and a toner storage unit according to some embodiments of the present invention are described in detail below.

Toner

The toner according to an embodiment of the present invention comprises mother particles and an external additive. The mother particles comprise a binder resin. The external additive comprises inorganic particles comprising small-size inorganic particles having an equivalent circle diameter of from 30 to 70 nm and large-size inorganic particles having an equivalent circle diameter of from 150 to 200 nm and a circularity of 0.85 or more. The number of the large-size inorganic particles is from 20 to 70 per 100 $\mu m^2$ image area of the toner observed with a field-emission scanning electron microscope.

A technique of externally adding small-size inorganic particles as a fluidizer to toner is generally known for adjusting fluidity and chargeability of the toner to achieve good development characteristics. However, since the small-size inorganic particles tend to be embedded in the toner surface due to mechanical stress received in a developing device, the toner is unable to maintain fluidity over an extended period of time. In addition, if a large amount of small-size inorganic particles is added for securing fluidity, a problem may occur that the small-size inorganic particles separate from the surface of toner and migrate to carriers and photoconductors.

In attempting to solve this problem, an external additive has been proposed which comprises hydrophobic inorganic particles obtained by hydrophobizing small-size inorganic particles and large-size inorganic particles simultaneously in a single treatment tank. As another approach, an external additive having a true specific gravity of 1.9 or less has been proposed, comprising a monodisperse spherical silica having true specific gravity of 1.3 to 1.9 and a volume average particle diameter of 80 to 300 nm. However, these external additives have not solved the problem because they are not physically held on the surface of the toner.

Further, an external additive comprising organic-inorganic composite particles having a plurality of protrusions derived from inorganic particles has been proposed, for enhancing diffusibility on the toner surface. This external additive is thermally fixed to the toner surface by a hot air treatment. However, in this approach, the external additive is a special (unusual) material and the hot air treatment may adversely affect wax on the toner surface.

Furthermore, an external additive comprising irregular-shape silica particles in combination with spherical silica particles has been proposed. While the spherical silica particles secure fluidity of the toner, the irregular silica particles form a dam at a contact portion of a photoconductor with a cleaning blade to suppress the separated spherical silica particles from slipping through the cleaning blade. However, there remains a possibility that the silica particles separated from the toner surface may migrate to photoconductors and carriers.

The toner according to an embodiment of the present invention comprises an external additive comprising small-size inorganic particles having an equivalent circle diameter of from 30 to 70 nm and large-size inorganic particles having an equivalent circle diameter of from 150 to 200 nm and a circularity of 0.85 or more, and the number of the large-size inorganic particles per 100 $\mu m^2$ image area of the toner observed with a field-emission scanning electron microscope is from 20 to 70. With this configuration, the large-size inorganic particles roll on the surface of the toner. As the large-size inorganic particles roll on the surface of the toner, the small-size inorganic particles having an equivalent circle diameter of from 30 to 70 nm, which are easily separable from the toner surface, get partially embedded in the toner surface and immobilized thereon, thus being suppressed from separating from the toner surface. As a result, separation of the small-size inorganic particles from the toner and adhesion/accumulation of the separated particles to/on a photoconductor and the inside of a developing device is suppressed.

As the small-size inorganic particles having an equivalent circle diameter of from 30 to 70 nm are immobilized on the toner surface, a spacer effect is exhibited. In particular, due to the spacer effect, inorganic particles having an equivalent circle diameter of less than 30 nm, which exert a large effect on improvement of fluidity of the toner, are prevented from being embedded in the toner surface by mechanical stress and excellent fluidity is thereby maintained for an extended period of time.

The large-size inorganic particles having an equivalent circle diameter of from 150 to 200 nm are more liable to separate from the toner surface than the small-size inorganic particles are (those having an equivalent circle diameter of 200 nm or more are much more liable to separate from the toner surface). Therefore, if the external additive contains the large-size inorganic particles in a large amount, the external additive may greatly contribute to deterioration of image quality caused by adhesion or accumulation of the external additive on a photoconductor cleaning unit and/or a transfer unit. Therefore, the amount of the large-size inorganic particles is set to the minimum necessary for fixing the inorganic particles for bringing about the spacer effect.

The equivalent circle diameter of the large-size inorganic particles is in a range of from 150 to 200 nm, more preferably from 170 to 200 nm. When the equivalent circle diameter is smaller than 150 nm, it is impossible to immobilize the small-size inorganic particles having an equivalent circle diameter of from 30 to 70 nm that are the target for immobilization, and inorganic particles with a much smaller size are immobilized on the toner surface. As a result, the effect as fluidizer deteriorates and excellent fluidity cannot be maintained over an extended period of time. When the equivalent circle diameter is larger than 200 nm, the adhesion force to the toner surface is so weak that the large-size inorganic particles may separate from the toner surface without rolling on the toner surface, and the small-size inorganic particles cannot be immobilized on the toner surface.

The circularity of the large-size inorganic particles is 0.85 or more. When the circularity is less than 0.85, the large-size inorganic particles cannot roll on the toner surface and the small-size inorganic particles having an equivalent circle diameter of from 30 to 70 nm cannot be immobilized on the toner surface.

As to the content of the large-size inorganic particles in the toner, the number of the large-size inorganic particles is from 20 to 70, more preferably from 40 to 60, per 100 $\mu m^2$ image area of the toner observed with a field-emission scanning electron microscope. When the number per 100 $\mu m^2$ image area of the toner is less than 20, the total area of the toner surface where the large-size inorganic particles can roll on is too small to adequately immobilize the small-size inorganic particles having an equivalent circle diameter of from 30 to 70 nm on the toner surface. When the number per 100 $\mu m^2$ image area of the toner is 70 or larger, the amount of the large-size inorganic particles is more than necessary for immobilization. Inorganic particles having an equivalent circle diameter of from 150 to 200 nm and a high circularity have a weak adhesive force to the toner surface and are easy to separate therefrom. When the number thereof is larger than 70 per 100 $\mu m^2$ image area of the toner, the amount of separation from the toner surface increases, thereby increasing the risk of contaminating a photoconductor and the inside of a developing device.

When large-size inorganic particles having an equivalent circle diameter of from 150 to 200 nm and a circularity of less than 0.85 are present in a large amount, the amount of separation from the toner surface increases, thereby increasing the risk of contaminating a photoconductor and the inside of a developing device. Therefore, it is desirable that the number of large-size inorganic particles having an equivalent circle diameter of from 150 to 200 nm and a circularity of less than 0.85 be 70 or less per 100 $\mu m^2$ image area of the toner.

The small-size inorganic particles have an equivalent circle diameter of from 30 to 70 nm. Preferably, the small-size inorganic particles having an equivalent circle diameter of from 30 to 70 nm accounts for 15% by number or more of the inorganic particles having an equivalent circle diameter of 10 nm or more. More preferably, the number of the small-size inorganic particles having an equivalent circle diameter of from 30 to 70 nm accounts for 35% by number or more of the inorganic particles having an equivalent circle diameter of 10 nm or more. When the small-size inorganic particles consist of those having an equivalent circle diameter less than 30 nm without comprising those having an equivalent circle diameter of from 30 to 70 nm, such small-size inorganic particles are effective for improving fluidity of the toner but are immobilized on the toner surface by the large-size inorganic particles without improving fluidity of the toner. Further, such small-size inorganic particles are embedded in the toner surface due to mechanical stress received in a developing device, resulting in deterioration of developability and transferability over time. Such a toner is unable to exhibit sufficient durability as a developer.

Preferably, a coverage rate of the mother particles with the inorganic particles having an equivalent circle diameter of 10 nm or more is from 30% to 80%, more preferably from 40% to 70%. When the coverage rate is less than 30%, the number of inorganic particles present on the toner surface is too small. Therefore, while the small-size inorganic particles having an equivalent circle diameter of from 30 to 70 nm are effectively pushed in and immobilized on the toner surface by the large-size inorganic particles, inorganic particles having an equivalent circle diameter of less than 30 nm are also immobilized on the toner surface to degrade fluidity. When the coverage rate is larger than 80%, the number of inorganic particles present on the toner surface is too large. Therefore, the inorganic particles become physical obstructions for the large-size inorganic particles having an equivalent circle diameter of from 150 to 200 nm rolling on the toner surface, resulting in poor pushing effect.

The toner according to an embodiment of the present invention comprises mother particles comprising a binder resin, and an external additive covering the mother particles.

The mother particles may further contain a release agent, a charge control agent, a wax dispersing agent, and/or a colorant, other than the binder resin.

Binder Resin

The binder resin (a resin for fixing), which is one of toner materials, is not particularly limited and may be appropriately selected according to the purpose. Any conventionally known resin can be used.

Examples of the binder resin include, but are not limited to, styrene-based resins (homopolymers and copolymers comprising styrene or a derivative of styrene) such as polystyrene, poly-α-methyl styrene, styrene-chlorostyrene copolymer, styrene-propylene copolymer, styrene-butadiene copolymer, styrene-vinyl chloride copolymer, styrene-vinyl acetate copolymer, styrene-maleic acid copolymer, styrene-acrylate copolymer, styrene-methacrylate copolymer, styrene-methyl α-chloroacrylate copolymer, and styrene-acrylonitrile-acrylate copolymer, as well as epoxy resins, vinyl chloride resins, rosin-modified maleic acid resins, phenol resins, polyethylene resins, polypropylene resins, petroleum resins, polyurethane resins, ketone resins, ethylene-ethyl acrylate copolymer, xylene resins, and polyvinyl butyrate resins. The production method of these resins is also not particularly limited, and any of bulk polymerization, solution polymerization, emulsion polymerization, and suspension polymerization can be employed.

Preferably, the binder resin includes a polyester resin, more preferably as a main component. Polyester resin can be fixed at lower temperature compared with other resins while maintaining storage stability resistant to high temperature and high humidity. Therefore, polyester resin is suitable for the binder resin of the present embodiment.

Preferably, the content of the binder resin in 100 parts by mass of the toner is from 60 to 95 parts by mass, more preferably from 75 to 90 parts by mass.

The polyester resin according to the present embodiment is obtained by polycondensation of an alcohol with a carboxylic acid.

Specific examples of the alcohol include, but are not limited to: glycols such as ethylene glycol, diethylene glycol, triethylene glycol, and propylene glycol; etherified bisphenols such as 1,4-bis(hydroxymethyl)cyclohexane and bisphenol A; divalent alcohol monomers; and polyvalent alcohol monomers having a valence of 3 or more.

Specific examples of the carboxylic acid include, but are not limited to: divalent organic acid monomers such as maleic acid, fumaric acid, phthalic acid, isophthalic acid, terephthalic acid, succinic acid, and malonic acid; and polyvalent carboxylic acid monomers having a valence of 3 or more such as 1,2,4-benzenetricarboxylic acid, 1,2,5-benzenetricarboxylic acid, 1,2,4-cyclohexanetricarboxylic acid, 1,2,4-naphthalenetricarboxylic acid, 1,2,5-hexanetricarboxylic acid, 1,3-dicarboxyl-2-methylenecarboxypropane, and 1,2,7,8-octanetetracarboxylic acid.

Preferably, the polyester resin has a glass transition temperature (Tg) of from 50° C. to 75° C.

Release Agent

The release agent is not particularly limited and may be appropriately selected according to the purpose. One release agent may be used alone, or two or more release agents may be used in combination.

Examples of the release agent include, but are not limited to: aliphatic hydrocarbons such as liquid paraffin, microcrystalline wax, natural paraffin, synthetic paraffin, and polyolefin wax, and partial oxides, fluorides, and chlorides thereof; animal oils such as beef tallow and fish oil; vegetable oils such as coconut oil, soybean oil, rapeseed oil, rice bran wax, and carnauba wax; higher aliphatic alcohols and higher fatty acids such as montan wax; fatty acid amides and fatty acid bisamides; metal soaps such as zinc stearate, calcium stearate, magnesium stearate, aluminum stearate, zinc oleate, zinc palmitate, magnesium palmitate, zinc myristate, zinc laurate, and zinc behenate; fatty acid esters; and polyvinylidene fluoride. Preferably, the release agent comprises an ester wax. Since the ester wax has low compatibility with general polyester binder resins, the ester wax easily exudes out to the surface of the toner at the time the toner gets fixed. Thus, the toner exhibits high releasability while securing sufficient low-temperature fixability.

Preferably, the content of the ester wax in 100 parts by mass of the toner is from 4 to 8 parts by mass, more preferably from 5 to 7 parts by mass. When the content is 4 parts by mass or more, a sufficient amount of the release agent exudes out from the surface of the toner at the time the toner gets fixed, thereby improving releasability, low-temperature fixability, and hot offset resistance. When the content is 8 parts by mass or less, the amount of the release agent precipitated on the surface of the toner image does not excessively increase, thereby improving storage stability and resistance to filming (on a photoconductor, etc.) of the toner.

Preferred examples of the ester wax include a synthetic monoester wax. Examples of the synthetic monoester wax include, but are not limited to, a monoester wax synthesized from a long-chain linear saturated fatty acid and a long-chain linear saturated alcohol.

Specific examples of the long-chain linear saturated fatty acid include, but are not limited to, capric acid, undecylic acid, lauric acid, tridecylic acid, myristic acid, pentadecylic acid, palmitic acid, heptadecanoic acid, tetradecanoic acid, stearic acid, nonadecanoic acid, arachidic acid, behenic acid, lignoceric acid, cerotic acid, heptacosanoic acid, montanic acid, and melissic acid. Specific examples of the long-chain linear saturated alcohol include, but are not limited to, amyl alcohol, hexyl alcohol, heptyl alcohol, octyl alcohol, capryl alcohol, nonyl alcohol, decyl alcohol, undecyl alcohol, lauryl alcohol, tridecyl alcohol, myristyl alcohol, pentadecyl alcohol, cetyl alcohol, heptadecyl alcohol, stearyl alcohol, nonadecyl alcohol, eicosyl alcohol, ceryl alcohol, and heptadecanol, all of which may have a substituent such as a lower alkyl group, amino group, and halogen.

Charge Control Agent

The toner may contain a charge control agent.

The charge control agent is not particularly limited and may be appropriately selected depending on the purpose. Examples thereof include, but are not limited to: nigrosine and modified products with fatty acid metal salts; onium salts such as phosphonium salt and lake pigments thereof; triphenylmethane dyes and lake pigments thereof; metal salts of higher fatty acids; diorganotin oxides such as dibutyltin oxide, dioctyltin oxide, and dicyclohexyltin oxide; diorganotin borates such as dibutyltin borate, dioctyltin borate, and dicyclohexyltin borate;

organometallic complexes, chelate compounds, monoazo metal complexes, acetylacetone metal complexes, and metal complexes of aromatic hydroxycarboxylic acids and aromatic dicarboxylic acids; quaternary ammonium salts; aromatic hydroxycarboxylic acids and aromatic mono- and poly-carboxylic acids and metal salts, anhydrides, and esters thereof; and phenol derivatives such as bisphenols.

Each of these materials can be used alone or in combination with others.

When the charge control agent is added to the inside of the toner, the content thereof is preferably from 0.1 to 10 parts by mass based on 100 parts by mass of the binder resin. To prevent undesirable coloring of the toner by the charge control agent, a transparent material is preferably selected except for the case of black toner.

Wax Dispersing Agent

The toner according to the present embodiment preferably contains a wax dispersing agent. Preferably, the wax dispersing agent is a copolymer composition comprising at least styrene, butyl acrylate, and acrylonitrile as monomers, or a polyethylene adduct of the copolymer composition.

Generally, styrene resin is more compatible with a typical wax compared with polyester resin, which is the binder resin of the toner according to the present embodiment, and the wax dispersed in the styrene resin tends to be small in size. In addition, styrene resin has a weaker internal cohesive force and better pulverizability than polyester resin. Therefore, even when the dispersion state of wax in styrene resin is equivalent to that in polyester resin, it is less likely that the interface between the wax and the styrene resin becomes a pulverization surface compared with the interface between the wax and the polyester resin. Styrene resin is capable of suppressing the wax from being exposed at the surfaces of the toner particles, thereby improving heat-resistant storage stability of the toner.

A combination of styrene resin and polyester resin, which is the binder resin of the toner according to the present embodiment, is likely to lower the image gloss because they are incompatible with each other. The above-described copolymer composition comprising butyl acrylate as an acrylic species, which is one type of styrene resins, has a solubility parameter close to that of polyester resin. Therefore, when this copolymer composition, even incompatible with the binder resin, is used as the wax dispersing agent, lowering of the image gloss is suppressed. Since the acrylic species is butyl acrylate, thermal properties of the copolymer composition are similar to those of polyester resin. Therefore, the copolymer composition does not largely disturb low-temperature fixability and internal cohesive force of the polyester resin.

The content of the wax dispersing agent in 100 parts by mass of the toner is preferably 7 parts by mass or less. The wax dispersing agent has an effect of dispersing the wax in the toner, so that storage stability of the toner is reliably improved regardless of production method of the toner. In addition, the diameter of the wax is reduced due to the effect of the wax dispersing agent, so that the toner is suppressed from filming on a photoconductor, etc. When the content is 7 parts by mass or less, the amount of polyester-incompatible components is not excessive so that gloss decrease is prevented. Also, dispersibility of the wax is not excessive, so that the wax sufficiently exudes out to the surface of the toner at the time the toner gets fixed, improving low-temperature fixability and hot offset resistance.

Colorant

Specific examples of the colorant include, but are not limited to, known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LTTHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarin Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, 1NDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, and combinations thereof.

The content of the colorant in the toner is typically from 1% to 15% by mass and preferably from 3% to 10% by mass.

The colorant can be combined with a resin to be used as a master batch.

Specific examples of the resin to be used for the master batch include, but are not limited to, polymers of styrene or a derivative thereof (e.g., polystyrene, poly-p-chlorostyrene, polyvinyl toluene) and copolymer thereof with vinyl compounds, polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, paraffin wax, and combinations thereof.

External Additive

As described above, the external additive of the toner according to the present embodiment comprises inorganic particles comprising small-size inorganic particles having an equivalent circle diameter of from 30 to 70 nm and large-size inorganic particles having an equivalent circle diameter of from 150 to 200 nm and a circularity of 0.85 or more, and the number of the large-size inorganic particles per 100 $\mu m^2$ image area of the toner observed with a field-emission scanning electron microscope is from 20 to 70.

Specific examples of the external additive include, but are not limited to: abrasive agents such as silica, cerium oxide powder, silicon carbide powder, and strontium titanate powder; fluidity imparting agents such as titanium oxide powder and aluminum oxide powder; aggregation preventing agents; conductivity imparting agents such as zinc oxide powder, antimony oxide powder, and tin oxide powder; and developability improving agents such as reverse-polarity white particles and black particles. Each of these materials can be used alone or in combination with others. The external additive is so selected that the toner is imparted with resistance to stress caused by, for example, idling in the developing process.

Preferably, the external additive of the toner according to the present embodiment comprises silica particles. More preferably, silica particles have a hydrophobized surface for improving dispersibility. Silica particles may be hydrophobized by coating the surfaces thereof with an alkyl group, specifically by acting a known organosilicon compound having an alkyl group thereon.

Examples of usable hydrophobizing agent include, but are not limited to, known organosilicon compounds having an alkyl group (such as methyl group, ethyl group, propyl group, and butyl group). Specific examples thereof include, but are not limited to, silane compounds (e.g., methyltrimethoxysilane, dimethyldimethoxysilane, trimethylchlorosilane, trimethylmethoxysilane) and silazane compounds (e.g., hexamethyldisilazane, tetramethyldisilazane). Each of these hydrophobizing agents may be used alone or in combination with the others. Among these hydrophobizing agents, organosilicon compounds having trimethyl group are preferable, such as trimethylmethoxysilane and hexamethyldisilazane.

Measurement of Particle Size Distribution of External Additive Particles on Toner Surface In the present disclosure, the circularity, equivalent circle diameter, and particle area of the external additive are measured by observing the toner to the surface of which the external additive adheres.

The measurement may be carried out using a scanning electron microscope SU8200 series (available from Hitachi High-Technologies Corporation). The obtained image is analyzed with an image processing software program A-zoukun (available from Asahi Kasei Engineering Corporation) to recognize the external additive particles by binarization and to calculate circularity, equivalent circle diameter, and particle area. The equivalent circle diameter refers to a diameter of a circle having the same area as the particle area measured above.

The number of the large-size inorganic particles having an equivalent circle diameter of from 150 to 200 nm and a circularity of 0.85 or more per 100 $\mu m^2$ image area of the toner observed with FE-SEM is determined by analyzing each large-size inorganic particle by image analysis to check whether or not the equivalent circle diameter is from 150 to 200 nm and the circularity is 0.85 or more. The area of 100 $\mu m^2$ is a total area in a two-dimensional image, not a three-dimensional image, of the toner surface. The area is not specifically designated on the toner surface. In the present disclosure, multiple portions on the toner surface are observed to obtain multiple images so that the area is totaled 100 $\mu m^2$. The number of images to obtain is not particularly limited.

The coverage rate with the external additive is calculated from the total of the particle areas determined above. The number-based particle size distribution of the external additive is determined based on the equivalent circle diameter determined above. Here, "the particles areas" are determined by observing a part of the two-dimensional image of the toner surface. Since the lower limit of the particle size observable by the scanning electron microscope is 10 nm, the coverage rate is determined with inorganic particles having an equivalent circle diameter of 10 nm or more.

Measurement of Toner Properties

Measurement of Volume Average Particle Diameter of Toner

The volume average particle diameter of the toner can be measured by various methods. For example, it can be measured using an instrument COULTER COUNTER MULTISIZER III in the following manner. First, a measurement sample is prepared by dispersing the toner in an electrolytic solution containing a surfactant by an ultrasonic disperser for one minute, and 50,000 toner particles dispersed therein are subjected to a measurement by the above instrument.

Measurement of Molecular Weight of Resin

The number average molecular weight and weight average molecular weight of resins are determined from a molecular weight distribution of THF-soluble matter which is measured by a GPC (gel permeation chromatography) measuring instrument GPC-150C (manufactured by Waters Corporation).

The measurement is conducted using columns (SHODEX KF 801 to 807 manufactured by Showa Denko K.K.) as follows. The columns are stabilized in a heat chamber at 40° C. Tetrahydrofuran (THF) as a solvent is let to flow in the columns at that temperature at a flow rate of 1 milliliter per minute. Next, 0.05 g of a sample is thoroughly dissolved in 5 g of THF and filtered with a pretreatment filter (e.g., a chromatographic disk having a pore size of 0.45 μm (manufactured by KURABO INDUSTRIES LTD.)) to prepare a THF solution of the sample having a sample concentration of from 0.05% to 0.6% by mass, and 50 to 200 μl thereof is injected in the measuring instrument. The weight average molecular weight (Mw) and the number average molecular weight (Mn) of the THF-soluble matter in the sample are determined by comparing the molecular weight distribution of the sample with a calibration curve that has been compiled with several types of monodisperse polystyrene standard samples. Specifically, the calibration curve shows the relation between the logarithmic values of molecular weights and the number of counts.

The polystyrene standard samples are those having molecular weights of $6\times10^2$, $2.1\times10^2$, $4\times10^2$, $1.75\times10^4$, $5.1\times10^4$, $1.1\times10^5$, $3.9\times10^5$, $8.6\times10^5$, $2\times10^6$, and $4.48\times10^6$, respectively, available from Pressure Chemical Company (those available from Tosoh Corporation are also usable). Since the calibration curve is preferably prepared using at least 10 standard polystyrene samples, the above polystyrene standard samples are used in the present disclosure. As the detector, a refractive index (RI) detector is used.

Measurement of Glass Transition Temperature (Tg) of Binder Resin

The glass transition temperature (Tg) is measured using a differential scanning calorimeter (DSC210 available from Seiko Instrument Inc.) as follows. First, 0.01 to 0.02 g of a sample is weighed in an aluminum pan, and heated to 200° C. and subsequently cooled to 20° C. at a temperature falling rate of 10° C./min. The cooled sample is heated again at a temperature rising rate of 10° C./min. Tg is defined as a temperature at the intersection of an extended line of a base line of the endothermic curve at or below the temperature of the highest peak, and a tangent line of the endothermic curve which indicates the maximum slope between the peak rising portion and the peak top.

Measurement of Liberation Ratio of External Additive from Toner

A liberation ratio is measured as follows. First, 3.74 to 3.76 g of the toner and 50 ml of a surfactant are placed in a 100-ml screw tube and they are stirred for 10 minutes so that the toner and the surfactant are well mixed. The resulting toner dispersion liquid is transferred from the screw tube to a mini cup and applied with ultrasonic energy at 40 W for one minute. Next, the toner dispersion liquid to which ultrasonic energy has been applied is transferred to a 50-ml centrifuge tube and centrifuged at 2,000 rpm for 2 minutes. The resulting supernatant is discarded. Next, 30 ml of pure water is put into the centrifuge tube. The precipitated toner is stirred with a spatula and moisture is removed by suction filtration. Again, 30 ml of pure water is put into the centrifuge tube, and the completely precipitated toner is poured into a funnel. After being dried, the toner is taken out and finely crushed with a spatula, and is further dried in a high-temperature tank at 38° C. for 8 hours. Next, 3.0 g of the dried toner having the above ultrasonic treatment and 3.0 g of the toner without the ultrasonic treatment are each pelletized with a pressure molding machine at 6 MPa for 1 minute. The pellets are examined with an X-ray fluorescence analyzer (ZSX Primus II manufactured by Rigaku Corporation) to measure the strengths of Si and Ti that are the main components of the inorganic particles.

The liberation ratio of the external additive is calculated from the following formula.

(External additive liberation ratio)={(Measured value of toner before ultrasonic treatment−Measured value of toner after ultrasonic treatment)/(Measured value of toner before ultrasonic treatment)}×100

Method for Manufacturing Toner

The toner can be manufactured by any known method as long as the toner satisfies the above-described requirements. For example, the toner may be manufactured by a kneading pulverization method or a chemical method that granulates toner particles in an aqueous medium.

For example, the toner according to the present embodiment may be prepared as follows. First, the binder resin is well mixed with the release agent, the colorant, the wax dispersing agent, and/or the charge control agent by a mixer such as HEN SCHEL MIXER and SUPER MIXER. The mixture is then melt-kneaded by a hot melt kneader such as a heat roll, a kneader, and an extruder, so that the materials are thoroughly mixed. The kneaded mixture is cooled, solidified, and pulverized into fine particles, and the fine particles are classified by size to obtain a toner. The pulverizing process may be of a jet mill process in which a high-speed airflow incorporates toner particles to let the toner particles collide with a collision plate and be pulverized by the collision energy, an inter-particle collision process which lets toner particles collide with each other in an airflow, or a mechanical pulverizing process in which toner particles are supplied to a narrow gap formed with a rotor rotating at a high speed to be pulverized.

The toner according to the present embodiment may also be prepared by a dissolution suspension method. In this method, an oil phase is dispersed in an aqueous medium. Here, the oil phase comprises an organic solvent and toner materials dissolved or dispersed therein. After a reaction for forming a resin is conducted, removal of the solvent, filtration, washing, and drying are conducted, thus obtaining mother toner particles.

Developer

A developer according to an embodiment of the present invention comprises at least the above-described toner. The developer may be either a one-component developer or a two-component developer.

In a preferred embodiment, the toner is mixed with a carrier to form a two-component developer, which is used for an electrophotographic image forming method employing a two-component developing system.

For use in two-component developing system, fine particles of magnetic materials may be used a magnetic carrier. Specific examples of the magnetic material include, but are not limited to: magnetites; spinel ferrites containing gamma iron oxide; spinel ferrites containing at least one metal (e.g., Mn, Ni, Zn, Mg, and Cu) other than iron; magnetoplumbite-type ferrites such as barium ferrite; and particulate iron or alloy having an oxidized layer on its surface.

The magnetic material may be in any of granular, spherical, or needle-like shape. When high magnetization is required, ferromagnetic fine particles, such as iron, are preferably used. For chemical stability, magnetites, spinel ferrites containing gamma iron oxide, and magnetoplumbite-type ferrites such as barium ferrite are preferable.

Specific preferred examples thereof include, but are not limited to, commercially-available products such as MFL-35S and MFL-35HS (available from Powdertech Co., Ltd.); and DFC-400M, DFC-410M, and SM-350NV (available from Dowa IP Creation Co., Ltd.).

A resin carrier may also be used which has a desired magnetization by containing an appropriate type of magnetic fine particles in an appropriate amount. Such a resin carrier preferably has a magnetization strength of from 30 to 150 emu/g at 1,000 oersted. Such a resin carrier may be produced by spraying a melt-kneaded product of magnetic fine particles with an insulating binder resin by a spray dryer, or dispersing magnetic fine particles in a condensation-type binder resin by reacting/curing its monomer or prepolymer in an aqueous medium in the presence of magnetic fine particles.

Chargeability of the magnetic carrier may be controlled by fixedly adhering positively-chargeable or negatively-chargeable fine particles or conductive fine particles on the surface of the magnetic carrier, or coating the magnetic carrier with a resin.

Examples of the surface coating resin include silicone resin, acrylic resin, epoxy resin, and fluororesin. These resins may contain positively-chargeable or negatively-chargeable fine particles or conductive fine particles. Among these resins, silicone resin and acrylic resin are preferable.

Preferably, a mass ratio of the carrier in the developer stored in a developing device is 85% by mass or higher but less than 98% by mass. When the mass ratio is 85% by mass or more, toner is suppressed from scattering from the developing device, thereby suppressing the occurrence of defective images. When the mass ratio of the carrier in the developer is less than 98% by mass, an excessive increase of the charge amount of the toner and shortage of the toner to be supplied can suppressed, thereby effectively preventing a decrease of image density and the occurrence of defective images.

Image Forming Method and Image Forming Apparatus

An image forming apparatus according to an embodiment of the present invention includes: an electrostatic latent image bearer; an electrostatic latent image forming device configured to form an electrostatic latent image on the electrostatic latent image bearer; a developing device containing the above-described toner, configured to develop the electrostatic latent image with the toner to form a toner image; a transfer device configured to transfer the toner image formed on the electrostatic latent image bearer onto a surface of a recording medium; and a fixing device configured to fix the toner image on the surface of the recording medium.

An image forming method according to an embodiment of the present invention includes: an electrostatic latent image forming process in which an electrostatic latent image is formed on an electrostatic latent image bearer; a developing process in which the electrostatic latent image is developed with the above-described toner to form a toner image; a transfer process in which the toner image formed on the electrostatic latent image bearer is transferred onto a surface of a recording medium; and a fixing process in which the toner image is fixed on the surface of the recording medium. Preferably, the image forming method may further include a recycle process that cleans the surface of the electrostatic latent image bearer (hereinafter may be referred to as "photoconductor") after the toner image has been transferred onto the recording medium, to collect toner remaining thereon, and supplies the collected toner to the developing device for use in the developing process.

Details of the image forming method and the image forming apparatus are described below.

FIG. 1 is a schematic view of a full-color image forming apparatus employing the image forming method of the present embodiment.

The image forming apparatus illustrated in FIG. 1 includes a drive roller 101A, a driven roller 101B, a photoconductor belt 102, a charger 103, a laser writing unit 104, developing units 105A to 105D respectively containing yellow, magenta, cyan, and black toners, a sheet tray 106, an intermediate transfer belt 107, a drive shaft roller 107A for driving the intermediate transfer belt 107, a pair of driven shaft rollers 107B for supporting the intermediate transfer belt 107, a cleaner 108, a fixing roller 109, a pressure roller 109A, a sheet ejection tray 110, and a sheet transfer roller 113.

The intermediate transfer belt 107 has flexibility. The intermediate transfer belt 107 is stretched taut with the drive shaft roller 107A and the pair of driven shaft rollers 107B and circulatingly conveyed clockwise in FIG. 1. A part of the surface of the intermediate transfer belt 107 stretched between the driven shaft rollers 107B is in contact with the photoconductor belt 102, wound around the outer periphery of the drive roller 101A, in a horizontal direction.

In a regular full-color image forming operation, each time a toner image is formed on the photoconductor belt 102, the toner image is immediately transferred onto the intermediate transfer belt 107 to form a full-color composite toner image. The full-color composite toner image is transferred onto a transfer sheet that is fed from the sheet tray 106 by the sheet transfer roller 113. The transfer sheet having the composite toner image thereon is conveyed to between the fixing roller 109 and the pressure roller 109A in a fixing device. After the composite toner image is fixed on the transfer sheet by the fixing roller 109 and the pressure roller 109A, the transfer sheet is ejected on the sheet ejection tray 110.

As the developing units 105A to 105D develop images with respective toners, the toner concentration in each developer contained in each developing unit is decreased. A decrease of toner concentration in the developer is detected by a toner concentration sensor. As a decrease of toner concentration is detected, toner supply devices connected to respective developing units start operation to supply toner and increase toner concentration. In a case in which the developing unit is equipped with a developer ejection mechanism, a developer exclusive for trickle development in which the toner is mixed with a carrier may be supplied in place of the toner.

According to another embodiment, toner images may be directly transferred from a transfer drum onto a recording medium without being transferred onto an intermediate transfer belt in a superimposed manner as is the case illustrated in FIG. 1.

Figure 2:
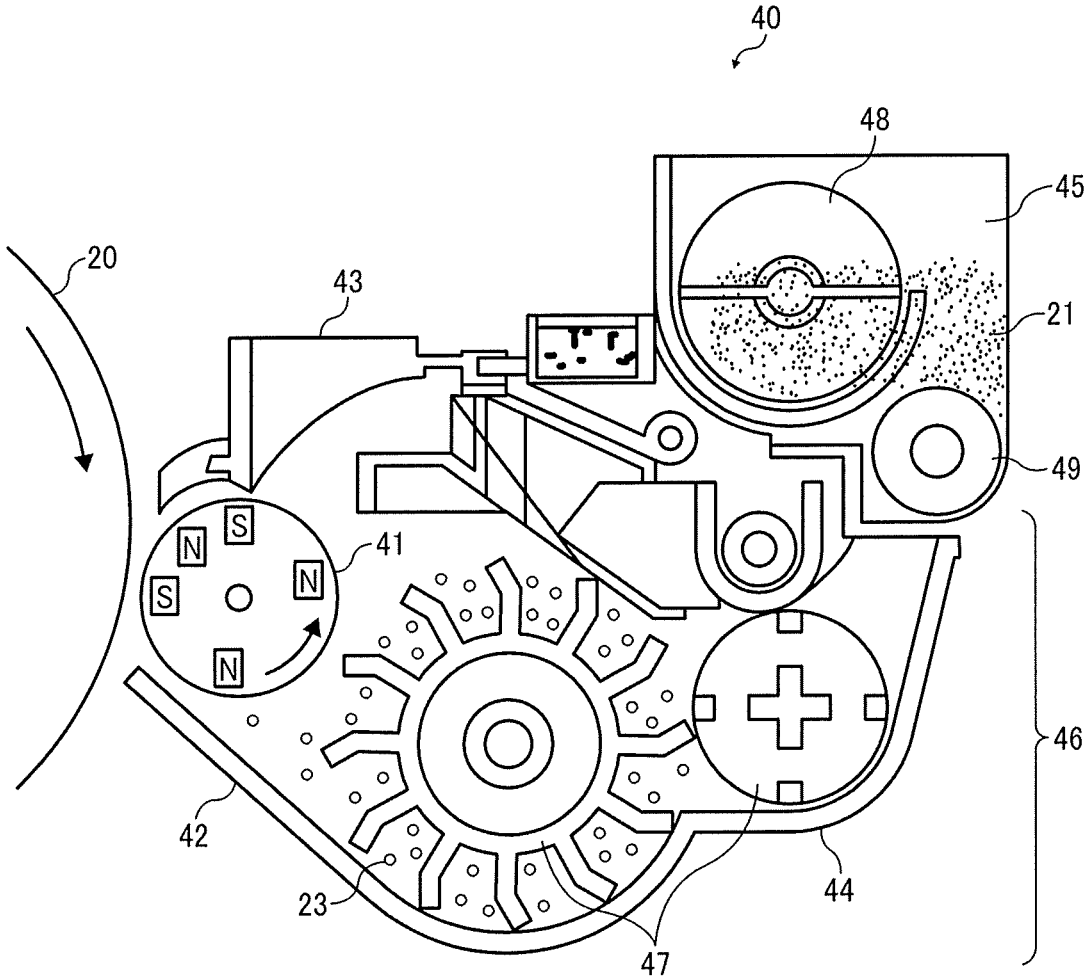
FIG. 2 is a schematic view of a developing device according to an embodiment of the present invention.

FIG. 2 is a schematic view of a developing device according to an embodiment of the present invention.

Referring to FIG. 2, a developing device 40 is disposed facing a photoconductor 20 serving as a latent image bearer. The developing device 40 includes a developing sleeve 41 serving as a developer bearer, a developer housing 42, a doctor blade 43 serving as a regulator, and a support casing 44.

The support casing 44 has an opening on the photoconductor 20 side. A toner hopper 45, serving as a toner container, containing a toner 21 is joined to the support casing 44. A developer container 46 contains a developer comprising the toner 21 and a carrier 23, and is disposed adjacent to the toner hopper 45. Inside the developer container 46, a developer stirring mechanism 47 is disposed configured to stir the toner 21 and the carrier 23 to give triboelectric/separation charge to the toner 21.

Inside the toner hopper 45, a toner agitator 48 and a toner supply mechanism 49 are disposed. The toner agitator 48 is driven to rotate by a driver. The toner agitator 48 and the toner supply mechanism 49 feed the toner 21 contained in the toner hopper 45 toward the developer container 46 by agitating the toner.

The developing sleeve 41 is disposed within a space formed between the photoconductor 20 and the toner hopper 45. The developing sleeve 41 is driven to rotate in a direction indicated by arrow in FIG. 2. Inside the developing sleeve 41, magnets serving as magnetic field generators are disposed with the relative positions thereof invariant to the developing device, for forming a magnetic brush of the carrier 23.

The doctor blade 43 is integrally installed to one side of the developer housing 42 opposite to a side to which the support casing 44 is installed. An edge of the doctor blade 43 is disposed facing the outer circumferential surface of the developing sleeve 41 forming a constant gap therebetween.

With the above configuration, the toner 21 is fed from the toner hopper 45 to the developer container 46 by the toner agitator 48 and the toner supply mechanism 49. The toner 21 is then stirred by the developer stirring mechanism 47 to be given a desired triboelectric/separation charge. The charged toner 21 is carried on the developing sleeve 41 together with the carrier 23 and conveyed to a position where the developing sleeve 41 faces the outer circumferential surface of the photoconductor 20. The toner 21 is electrostatically bound to an electrostatic latent image formed on the photoconductor 20, thus forming a toner image on the photoconductor 20.

Figure 3:
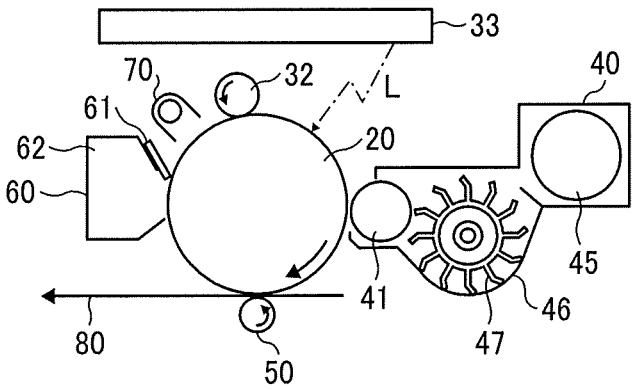
FIG. 3 is a schematic view of an image forming apparatus including the developing device illustrated in FIG. 2.

FIG. 3 is a schematic view of an image forming apparatus including the developing device illustrated in FIG. 2. The image forming apparatus illustrated in FIG. 3 includes a charger 32, an irradiator 33, the developing device 40, a transfer device 50, a cleaner 60, and a neutralization lamp 70, each of which being disposed around the photoconductor 20 having a drum-like shape. The charger 32 and the photoconductor 20 are out of contact with each other forming a gap having a distance of about 0.2 mm therebetween. The charger 32 charges the photoconductor 20 by forming an electric field in which an alternating current component is superimposed on a direct current component by a voltage applicator, thus effectively reducing charging unevenness.

A series of image forming processes can be explained based on a negative-positive developing mechanism. The photoconductor 20, represented by an organic photoconductor (OPC) having an organic photoconductive layer, is neutralized by the neutralization lamp 70, uniformly negatively charged by the charger 32 (e.g., charging roller), and irradiated with laser light L emitted from the irradiator 33, so that a latent image is formed thereon. In this case, the absolute value of the potential of the irradiated potion is lower than that of the non-irradiated portion.

The laser light L is emitted from a semiconductor laser and reflected by a polygon mirror that is rotating at a high speed, thus scanning the surface of the photoconductor 20 in its rotational axis direction. The latent image thus formed is developed into a toner image with a developer comprising toner and carrier having been supplied onto the developing sleeve 41 (serving as a developer bearer) disposed in the developing device 40. In developing the latent image, a voltage applicator applies a developing bias to between the developing sleeve 41 and the irradiated and non-irradiated portions on the photoconductor 20. The developing bias is a direct current voltage of an appropriate magnitude or that on which an alternating current is superimposed.

At the same time, a transfer medium 80 (e.g., paper sheet) is fed from a sheet feeding mechanism to between the photoconductor 20 and the transfer device 50 by a registration roller pair in synchronization with an entry of a leading edge of an image thereto, thus transferring the toner image onto the transfer medium 80. At this time, the transfer device 50 is preferably applied with a transfer bias having the opposite polarity to the toner charge. The transfer medium 80 is thereafter separated from the photoconductor 20, thus obtaining a transfer image.

Residual toner particles remaining on the photoconductor 20 are collected by a cleaning blade 61 into a toner collection chamber 62 disposed in the cleaner 60.

The collected toner particles may be conveyed to the developer container 46 and/or the toner hopper 45 by a toner recycler to be reused.

The image forming apparatus includes a plurality of the above developing units. A plurality of toner images may be sequentially transferred onto the transfer medium and thereafter fed to a fixing device to be fixed on the transfer medium by heat. Alternatively, a plurality of toner images may be once transferred onto an intermediate transfer medium and then transferred onto the transfer medium all at once and fixed thereon.

Figure 4:
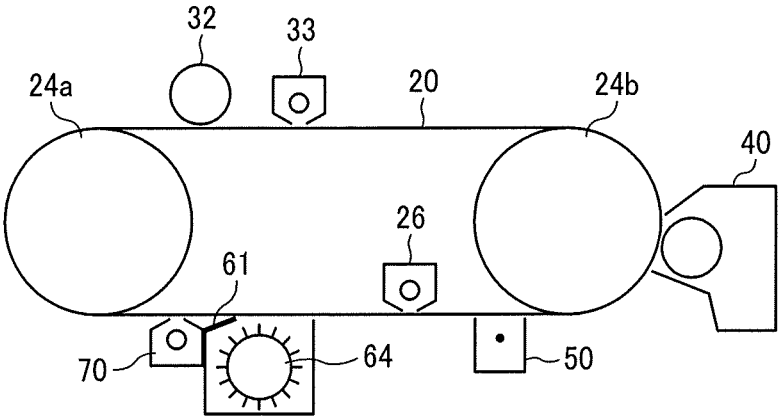
FIG. 4 is a schematic view of another image forming apparatus according to an embodiment of the present invention.

FIG. 4 is a schematic view of another image forming apparatus according to an embodiment of the present invention. In this image forming apparatus, a photoconductor 20 comprises a conductive substrate and a photosensitive layer disposed thereon. The photoconductor 20 is driven by drive rollers 24*a* and 24*b*, charged by a charger 32, and irradiated with light emitted from an irradiator 33, so that a latent image is formed thereon. The latent image is developed by a developing device 40 and transferred by a transfer device 50. The photoconductor 20 is irradiated with light emitted from a pre-cleaning irradiator 26 before being cleaned, cleaned by a brush cleaner 64 and a cleaning blade 61, and neutralized by a neutralization lamp 70. These operations are repeatedly performed. In the embodiment illustrated in FIG. 4, the photoconductor 20 is irradiated with light from the substrate side before being cleaned. In this case, the substrate is light-transmissive.

Toner Storage Unit

In the present disclosure, a toner storage unit refers to a unit that has a function of storing toner and that stores the above toner. The toner storage unit may be in the form of, for example, a toner storage container, a developing device, or a process cartridge.

In the present disclosure, the toner storage container refers to a container storing the toner.

The developing device refers to a device storing the toner and having a developing unit configured to develop an electrostatic latent image into a toner image with the toner.

The process cartridge refers to a combined body of an electrostatic latent image bearer (or an image bearer) with a developing unit storing the toner, detachably mountable on an image forming apparatus. The process cartridge may further include at least one of a charger, an irradiator, and a cleaner.

EXAMPLES

Hereinafter, the present invention is described in detail with reference to the following examples.

Further understanding of the present disclosure can be obtained by reference to certain specific examples provided herein below for the purpose of illustration only and are not intended to be limiting.

In the following descriptions, "parts" represent "parts by mass" unless otherwise specified.

Production Example of Polyester Resin

A reaction vessel equipped with a condenser, a stirrer, and a nitrogen inlet pipe was charged with 258 parts of propylene oxide 2 mol adduct of bisphenol A, 1,344 parts of ethylene oxide 2 mol adduct of bisphenol A, 800 parts of terephthalic acid, and 1.8 parts of tetrabutoxy titanate as a condensation catalyst. The mixture was subjected to a reaction at 230° C. for 6 hours under nitrogen gas flow while removing the by-product water. The mixture was further subjected to a reaction under reduced pressures of from 5 to 20 mmHg for 1 hour and then cooled to 180° C. After adding 10 parts of trimellitic anhydride, the mixture was further subjected to a reaction under reduced pressures of from 5 to 20 mmHg until the weight average molecular weight and the number average molecular weight of the reaction product reach 30,000 and 2,300, respectively. Thus, a polyester resin was prepared.

Production Example of Monoester Wax

A 1-liter four-neck flask equipped with a thermometer, a nitrogen introducing tube, a stirrer, and a cooling tube was charged with fatty acid components comprising 50 parts by mass of cerotic acid and 50 parts by mass of palmitic acid and alcohol components comprising 100 parts by mass of ceryl alcohol. The total amount of the fatty acid components and the alcohol components was 500 g. These components were subjected to a reaction at 220° C. at normal pressure for 15 hours or more under nitrogen gas flow while distilling reaction products away. Thus, a monoester wax having a melting point of 70.5° C. was prepared.

Production Examples of External Additives

Production Example of Inorganic Particles A1

In a 3-liter glass reactor equipped with a stirrer, a dropping funnel, and a thermometer, 693.0 parts of methanol, 46.0 parts of water, and 55.3 parts of 28% ammonia water were mixed. The temperature of the resulting solution was adjusted to 35° C., and 1,293.0 parts (8.5 mol) of tetramethoxysilane and 464.5 parts of 5.4% ammonia water were dropped in the solution over a period of 6 hours and 4 hours, respectively, while stirring the solution. The dropping was started simultaneously. Even after dropping of the tetramethoxysilane was completed, stirring was continued for 0.5 hours to conduct hydrolysis, thus obtaining a suspension of silica particles. Next, 547.4 parts (3.39 mol) of hexamethyldisilazane was put in the obtained suspension at room temperature, and the mixture was heated to 80° C. and subjected to a reaction for 3 hours, thus hydrophobizing silica particles. The solvent was thereafter distilled away under reduced pressures. Thus, 553.0 parts of inorganic particles Al having an average equivalent circle diameter of 170 nm were obtained.

Production Example of Inorganic Particles A2

Using a burner combustion method for combustible gas (i.e., using chemical flame), tetrachlorosilane as a raw material was mixed with hydrogen and air in advance. The mixture was supplied to a cylindrical reactor from the upper end thereof using a multi-tube burner to undergo a combustion reaction at a combustion temperature of 1,212° C. Thus, a fumed silica was prepared. The mixing ratio of the tetrachlorosilane gas, hydrogen gas, and air was adjusted to 1:5:14 based on volume. The obtained fumed silica was pulverized by a roll crusher pulverizer and subsequently by a bead mill crusher, thus obtaining silica particles.

The roll crusher pulverizer performed coarse pulverization under a roll gap of 0.2 mm and a roll rotation speed of 250 rpm. The resulting dry powder was classified by size using vibrating sieves having an opening of 25 μm and 75 μm, respectively, thus obtaining a silica powder having a volume average particle diameter D50 of 45 μm.

The silica powder thus obtained was mixed with water and a dispersing agent. The resulting slurry of silica particles was adjusted to have a concentration of 15% and subjected to a pulverization treatment using a bead-mill-type pulverizer at a rotor speed of 3,600 rpm for 4.5 hours. In this treatment, 100 g of beads having a diameter of 500 μm were used, and the amount of the slurry was 1,500 ml. The slurry was then subjected to spray drying using a spray dryer at a slurry feed rate of 1 L/h, a spraying pressure of 2 kg/cm$^2$, and a hot air temperature of 150° C., thus obtaining silica particles.

Next, 250 g of the silica particles thus obtained was put in a vibrating fluidized bed and 53 g of hexamethyldisilazane was sprayed into the treatment layer heated to 180° C. The mixture was fluidized and mixed for 40 minutes, thereby hydrophobizing the surfaces of the silica particles. Thus, inorganic particles A2 having an average equivalent circle diameter of 172 nm were obtained.

Production Example of Inorganic Particles A3

The procedure in Preparation Example of Inorganic Particles Al was repeated except for changing the stirring temperature to 40° C. Thus, 553.0 parts of inorganic particles A3 having an average equivalent circle diameter of 128 nm were obtained.

Production Example of Inorganic Particles A4

The procedure in Preparation Example of Inorganic Particles A2 was repeated except that the combustion temperature was changed to 1,805° C. and the pulverization time by the bead-mill-type pulverizer was changed to 6.0 hours. Thus, inorganic particles A4 having an average equivalent circle diameter of 133 nm were obtained.

Production Example of Inorganic Particles B1

The procedure in Preparation Example of Inorganic Particles Al was repeated except for changing the stirring temperature to 45° C. Thus, 553.0 parts of inorganic particles B1 having an average equivalent circle diameter of 50 nm were obtained.

Production Example of Inorganic Particles B2

The procedure in Preparation Example of Inorganic Particles Al was repeated except for changing the stirring temperature to 50° C. Thus, 553.0 parts of inorganic particles B2 having an average equivalent circle diameter of 25 nm were obtained.

Production Example of Inorganic Particles B3

A commercially-available product listed in Table 1 was used as inorganic particles B3.

The average equivalent circle diameter, average circularity, composition, and surface treatment of the inorganic particles are shown in Table 1.

TABLE 1

| | | Average equivalent circle diameter (nm) | Average circularity | Materials | Surface treatment | Product name | Manufacturer's name |
|---|---|---|---|---|---|---|---|
| Inorganic particles A | A1 | 170 | 0.85 | Silica | Hexamethyldisilazane treatment | — | — |
| | A2 | 172 | 0.66 | Silica | Hexamethyldisilazane treatment | — | — |
| | A3 | 128 | 0.93 | Silica | Hexamethyldisilazane treatment | — | — |
| | A4 | 133 | 0.64 | Silica | Hexamethyldisilazane treatment | — | — |
| Inorganic particles B | B1 | 50 | 0.90 | Silica | Hexamethyldisilazane treatment | — | — |
| | B2 | 25 | 0.85 | Silica | Hexamethyldisilazane treatment | — | — |
| | B3 | 18 | 0.92 | Silica | Hexamethyldisilazane treatment | H1303 | Clariant Japan K.K. |

Examples 1 to 9 and Comparative Examples 1 to 5

Production of Toner

Production of Mother Toner

Polyester resin (Mw: 30,000, Mn: 2,300): 90.0 parts

Styrene acrylic copolymer (EXD-001 manufactured by Sanyo Chemical Industries, Ltd., Tg: 68° C., Mw: 13,000): 5.0 parts Monoester wax (mp: 70.5° C.): 5.0 parts Salicylic acid derivative zirconium salt: 0.9 parts Carbon black (C-44 manufactured by Mitsui Chemicals, Inc.): 6.0 parts The toner raw materials listed above were preliminarily mixed by a HENSCHEL MIXER (FM20B available from NIPPON COKE & ENGINEERING CO., LTD.) and melt-kneaded by a single-shaft kneader (BUSS CO-KNEADER from Buss AG) at a temperature of from 100° C. to 130° C. The kneaded product was cooled to room temperature and pulverized into coarse particles having a diameter of from 200 to 300 μm by a ROTOPLEX. The coarse particles were further pulverized into fine particles having a weight average particle diameter of 5.4 ±0.3 μm by a COUNTER JET MILL (100AFG available from Hosokawa Micron Corporation) while appropriately adjusting the pulverization air pressure. The fine particles were classified by size using an air classifier (EJ-LABO available from MATSUBO Corporation) while appropriately adjusting the opening of the louver such that the weight average particle diameter became 5.8±0.4 μm and the ratio of weight average particle diameter to number average particle diameter became 1.25 or less. Thus, a mother toner was prepared. All the toners evaluated in the following Examples use the same mother toner.

Production of Toners 1 to 14

The mother toner prepared above in an amount of 100 parts was mixed with inorganic particles listed in Table 1 according to the external additive formulations shown in Table 2 using a HENSCHEL MIXER (FM20C/I manufactured by Nippon Coke & Engineering Co., Ltd.). Thus, toners 1 to 14 were obtained.

The external additive formulation, the number of large-size inorganic particles having an equivalent circle diameter of from 150 to 200 nm and a circularity of 0.85 or more per 100 $\mu m^2$ image area of each toner observed with FE-SEM, the coverage rate with inorganic particles having an equivalent circle diameter of 10 nm or more, the proportion (% by number) of inorganic particles having an equivalent circle diameter of from 30 to 70 nm in inorganic particles having an equivalent circle diameter of 10 nm or more, and the liberation ratio of the toners 1 to 14 are shown in Table 2.

The lower the liberation ratio, the more the separation of inorganic particles is suppressed and the more the adhesion of inorganic particles to a photoconductor or the inside of a developing device is suppressed, and the toner can maintain excellent fluidity for an extended period of time. The measured liberation ratio is ranked according to the following criteria.

A: less than 35%

B: 35% or more and less than 45%

C: 45% or more and less than 55%

D: 55% or more

TABLE 2

| | | Inorganic particles A | | Inorganic particles B | | Number of inorganic particles having equivalent circle diameter of 150-200 nm and circularity of 0.85 | | Proportion of inorganic particles having equivalent circle diameter of 30-70 nm | |
|---|---|---|---|---|---|---|---|---|---|
| | | Type | Parts | Type | Parts | or more per 100 $\mu m^2$ | Coverage rate | (% by number) | Liberation ratio |
| Example 1 | Toner 1 | A1 | 0.15 | B1 | 2.5 | 40 | 53% | 45% | A |
| Example 2 | Toner 2 | A1 | 0.08 | B1 | 2.5 | 23 | 57% | 47% | A |
| Example 3 | Toner 3 | A1 | 0.2 | B1 | 2.5 | 66 | 47% | 39% | A |
| Comparative Example 1 | Toner 4 | None | 0 | B1 | 2.5 | 0 | 50% | 52% | D |
| Comparative Example 2 | Toner 5 | A1 | 0.5 | B1 | 2.5 | 174 | 51% | 55% | D |
| Comparative Example 3 | Toner 6 | A2 | 0.15 | B1 | 2.5 | 0 | 58% | 46% | D |
| Comparative Example 4 | Toner 7 | A3 | 0.08 | B1 | 2.5 | 5 | 50% | 45% | D |
| Comparative Example 5 | Toner 8 | A4 | 0.08 | B1 | 2.5 | 0 | 55% | 57% | D |
| Example 4 | Toner 9 | A1 | 0.15 | B1 | 1.25 | 35 | 22% | 43% | A |
| Example 5 | Toner 10 | A1 | 0.15 | B1 | 1.5 | 40 | 33% | 49% | A |
| Example 6 | Toner 11 | A1 | 0.15 | B1 | 3.5 | 51 | 75% | 57% | A |
| Example 7 | Toner 12 | A1 | 0.15 | B1 | 4.5 | 52 | 87% | 50% | B |

TABLE 2-continued

| | | Inorganic particles A | | Inorganic particles B | | Number of inorganic particles having equivalent circle diameter of 150-200 nm and circularity of 0.85 | | Proportion of inorganic particles having equivalent circle diameter of 30-70 nm | |
|---|---|---|---|---|---|---|---|---|---|
| | | Type | Parts | Type | Parts | or more per 100 μm² | Coverage rate | (% by number) | Liberation ratio |
| Example 8 | Toner 13 | A1 | 0.15 | B2 | 1.5 | 47 | 49% | 29% | A |
| Example 9 | Toner 14 | A1 | 0.15 | B3 | 1 | 53 | 54% | 13% | A |

In Comparative Example 3, the toner 6 containing the inorganic particles A2 having an average equivalent circle diameter of 172 nm and an average circularity of 0.66 was prepared. The number of the large-size inorganic particles having an equivalent circle diameter of from 150 to 200 nm and a circularity of 0.85 or more per 100 $\mu m^2$ image area of the toner was 0. The number of inorganic particles having an equivalent circle diameter of from 150 to 200 nm and a circularity of less than 0.85 per 100 $\mu m^2$ image area of the toner was 55.

In Comparative Example 4, the toner 7 containing the inorganic particles A3 having an average equivalent circle diameter of 128 nm and an average circularity of 0.93 was prepared. The number of the large-size inorganic particles having an equivalent circle diameter of from 150 to 200 nm and a circularity of 0.85 or more per 100 $\mu m^2$ image area of the toner was 5. The number of inorganic particles having an equivalent circle diameter of from 120 to 149 nm and a circularity of 0.85 or more per 100 $\mu m^2$ image area of the toner was 52.

In Comparative Example 5, the toner 8 containing the inorganic particles A4 having an average equivalent circle diameter of 133 nm and an average circularity of 0.64 was prepared. The number of the large-size inorganic particles having an equivalent circle diameter of from 150 to 200 nm and a circularity of 0.85 or more per 100 $\mu m^2$ image area of the toner was 0. The number of inorganic particles having an equivalent circle diameter of from 120 to 149 nm and a circularity of less than 0.85 per 100 $\mu m^2$ image area of the toner was 44.

Production of Two-Component Developer

Preparation of Carrier A

Silicone resin (Organo straight silicone): 100 parts

Toluene: 100 parts

γ-(2-Aminoethyl) aminopropyl trimethoxysilane: 5 parts

Carbon black: 10 parts

The above materials were dispersed by a homomixer for 20 minutes to prepare a coating layer forming liquid. The coating layer forming liquid was applied to the surfaces of manganese (Mn) ferrite particles having a weight average particle diameter of 35 μm serving as a core material, using a fluidized bed coating device while controlling the temperature inside the fluidized bed to 70° C., and dried to have an average film thickness of 0.20 μm.

The core material having the coating layer was calcined in an electric furnace at 180° C. for 2 hours. Thus, a carrier A was prepared.

Preparation of Two-component Developer

The toner was uniformly mixed with the carrier A by a TURBULA MIXER (available from Willy A. Bachofen (WAB)) at a revolution of 48 rpm for 5 minutes to be charged. Thus, a two-component developer was prepared. The mixing ratio of the toner to the carrier was 4% by mass, which was equal to the initial toner concentration in the developer in the test machine.

Evaluations

The two-component developers containing the respective toners 1 to 14 were subjected to the following evaluations.

Photoconductor Contamination

The effect of external additives on contamination of photoconductor was evaluated using a digital full-color multifunction peripheral MP C306 manufactured by Ricoh Co., Ltd.

The degree of adhesion of components to the photoconductor was visually evaluated after a chart having an image density of 5% was output on 2,000 sheets.

Evaluation Criteria

A: Good. No adhesion observed.

B: Foggy traces or adhered matter slightly observed.

C: Foggy streaks or minute adhered matter observed but not output on the image.

D: Foggy areas and adhered matter significantly observed and output on the image as transfer failure or the like.

Toner Fluidity

Fluidity of toner was evaluated by a toner aggregation degree. Here, the toner aggregation degree is an index of the adhesive force between toner particles. The larger the toner aggregation degree, the larger the adhesive force between toner particles and the worse the flying property of toner particles in development process. The toner aggregation degree was measured using a powder tester (manufactured by Hosokawa Micron Corporation). Sieves respectively having an opening of 75 μm, 45 μm, and 22 μm were arranged in this order from the top, 2 g of toner was put on the top sieve having an opening of 75 μm, and a vibration having an amplitude of 1 mm was applied for 30 seconds. The mass values of the toner on the sieves having an opening of 75 μm, 45 μm, and 22 μm were measured after the vibration, multiplied by 0.5, 0.3, and 0.1, respectively, added together, and calculated as a percentage. The calculated percentage was evaluated according to the following criteria.

Evaluation Criteria

A: less than 10%

B: from 10% to 15%

C: from 15% to 20%

D: more than 20%

Overall Evaluation

Overall evaluation was comprehensively conducted based on the evaluation results for both photoconductor contamination and toner fluidity.

Evaluation Criteria

A: Both photoconductor contamination and toner fluidity are rank A.

B: One of photoconductor contamination and toner fluidity is rank A and the other is rank B; or both of them are rank B.

C: At least one of photoconductor contamination and toner fluidity is rank C but neither of them is rank D.

D: At least one of photoconductor contamination and toner fluidity is rank D.

The results are shown in Table 3.

TABLE 3

| | | Photoconductor Contamination | Toner Fluidity | Overall Evaluation |
|---|---|---|---|---|
| Example 1 | Toner 1 | A | A | A |
| Example 2 | Toner 2 | A | A | A |
| Example 3 | Toner 3 | A | A | A |
| Comparative Example 1 | Toner 4 | D | C | D |
| Comparative Example 2 | Toner 5 | D | C | D |
| Comparative Example 3 | Toner 6 | D | C | D |
| Comparative Example 4 | Toner 7 | D | C | D |
| Comparative Example 5 | Toner 8 | D | C | D |
| Example 4 | Toner 9 | A | B | B |
| Example 5 | Toner 10 | A | B | B |
| Example 6 | Toner 11 | A | A | A |
| Example 7 | Toner 12 | B | A | B |
| Example 8 | Toner 13 | A | B | B |
| Example 9 | Toner 14 | A | C | C |

It is clear from these results that the toners according to some embodiments of the present invention deliver good results in the evaluations of both photoconductor contamination and toner fluidity. Each toner maintains excellent fluidity for an extended period of time while suppressing separation of inorganic particles from the toner surface and adhesion of the separated inorganic particles to a photoconductor or the inside of a developing device.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

The invention claimed is:

1. A toner, comprising:

mother particles comprising a binder resin; and an external additive covering the mother particles, comprising inorganic particles comprising:

small-size inorganic particles having an equivalent circle diameter of from 30 to 70 nm; and large-size inorganic particles having an equivalent circle diameter of from 150 to 200 nm and a circularity of 0.85 or more, the large-size inorganic particles being 20 to 70 in number per 100 $\mu m^2$ image area of the toner observed with a field-emission scanning electron microscope, wherein a liberation ratio of the external additive from the toner is less than 35%.

2. The toner of claim 1, wherein a coverage rate of the mother particles with the inorganic particles having an equivalent circle diameter of 10 nm or more is from 30% to 80%.

3. The toner of claim 1, wherein the small-size inorganic particles having an equivalent circle diameter of from 30 to 70 nm account for 15% by number or more of the inorganic particles having an equivalent circle diameter of 10 nm or more.

4. The toner of claim 1, wherein the small-size inorganic particles having an equivalent circle diameter of from 30 to 70 nm account for 35% by number or more of the inorganic particles having an equivalent circle diameter of 10 nm or more.

5. An image forming apparatus, comprising:

an electrostatic latent image bearer;

an electrostatic latent image forming device configured to form an electrostatic latent image on the electrostatic latent image bearer;

a developing device comprising the toner of claim 1, configured to develop the electrostatic latent image with the toner to form a toner image;

a transfer device configured to transfer the toner image formed on the electrostatic latent image bearer onto a surface of a recording medium; and a fixing device configured to fix the toner image on the surface of the recording medium.

6. An image forming method, comprising:

forming an electrostatic latent image on an electrostatic latent image bearer;

developing the electrostatic latent image with the toner of claim 1 to form a toner image;

transferring the toner image formed on the electrostatic latent image bearer onto a surface of a recording medium; and fixing the toner image on the surface of the recording medium.

7. A toner storage unit, comprising:

a container; and the toner of claim 1 stored in the container.

* * * * *